US009371706B2

(12) United States Patent
Gubbins et al.

(10) Patent No.: US 9,371,706 B2
(45) Date of Patent: Jun. 21, 2016

(54) GRIPPING DIES FOR CONTINUOUS COILED ROD INJECTORS AND FABRICATION AND USE METHODS RELATING TO SAME

(71) Applicant: Celtic Machining Ltd., Rainier (CA)

(72) Inventors: Martin E. C. Gubbins, Rainier (CA); Sven W. Larsen, Rainier (CA)

(73) Assignee: Celtic Machining Ltd., Rainier, Alberta (CA)

( * ) Notice: Subject to any disclaimer, the term of this patent is extended or adjusted under 35 U.S.C. 154(b) by 361 days.

(21) Appl. No.: 13/785,420

(22) Filed: Mar. 5, 2013

(65) Prior Publication Data

US 2014/0251637 A1 Sep. 11, 2014

(51) Int. Cl.
*E21B 19/22* (2006.01)
*B66D 3/00* (2006.01)

(52) U.S. Cl.
CPC ..... *E21B 19/22* (2013.01); *B66D 3/003* (2013.01); *Y10T 29/49995* (2015.01)

(58) Field of Classification Search
USPC ..... 166/381, 77.3; 29/557
See application file for complete search history.

(56) References Cited

U.S. PATENT DOCUMENTS

| | | | | |
|---|---|---|---|---|
| 3,754,474 | A * | 8/1973 | Palynchuk | E21B 19/22 188/251 A |
| 5,094,340 | A | 3/1992 | Avakov | |
| 5,297,833 | A * | 3/1994 | Willis et al. | 294/102.2 |
| 5,309,990 | A * | 5/1994 | Lance | 166/77.3 |
| 5,853,118 | A * | 12/1998 | Avakov | 226/173 |
| 6,230,955 | B1 * | 5/2001 | Parks | B65G 37/005 166/77.3 |
| 6,425,441 | B2 | 7/2002 | Shaaban et al. | |
| 6,609,566 | B2 | 8/2003 | Perio, Jr. | |
| 6,880,629 | B2 | 4/2005 | Schroeder | |
| 6,892,810 | B2 | 5/2005 | Austbo et al. | |
| 7,857,042 | B2 | 12/2010 | Koopmans et al. | |
| 8,132,617 | B2 | 3/2012 | Magnus | |
| 2004/0188100 | A1 * | 9/2004 | Austbo et al. | 166/384 |
| 2010/0139461 | A1 * | 6/2010 | Bangert | 81/186 |
| 2012/0222855 | A1 | 9/2012 | Chartier | |

* cited by examiner

*Primary Examiner* — Taras P Bemko
(74) *Attorney, Agent, or Firm* — Kyle R. Satterthwaite; Ryan W. Dupuis; Ade & Company Inc.

(57) ABSTRACT

Gripper dies for a continuous coiled rod injector are machined from a single, unitary, integral steel body forming both the base portion for connection to the injector drive chain and the gripping portion for engagement of the continuous coiled rod. Curved transitions are provided between ends of a gripping portion of the die and a profiled gripping face thereof, which features an arcuate surface and diverging planar surfaces extending therefrom to accommodate varying sizes of round and elliptical rod.

18 Claims, 5 Drawing Sheets

GRIPPING DIES FOR CONTINUOUS COILED ROD INJECTORS AND FABRICATION AND USE METHODS RELATING TO SAME

FIELD OF THE INVENTION

The present invention relates generally to gripping dies used in injector heads for feeding a continuous coiled string into a well, and more particularly to gripping dies specifically developed for injection of continuous coiled rod.

BACKGROUND OF THE INVENTION

In the oilfield industry, it is becoming more common to employ continuous coiled rod instead of conventional sucker rod, for example for the purpose of driving downhole pump equipment, thereby avoiding the need to thread together discrete rod sections via threaded couplers at the ends thereof, and instead using an injector to feed a continuous rod string into the well from a coiled supply of the continuous rod. Such injectors typically employ a pair of endless chains driven in counter-rotating directions in a common upright plane, and carrying gripper dies or blocks on the chains that have outward facing gripping surfaces to clench the continuous rod between the faces of opposed gripper dies on the two chains as they descend downward on adjacent, facing-together, parallel sides of the two chain paths. A respective skate is found inside the area around which each train is driven to lie along this descending side of the chain, and is displaceable against this side of the chain by hydraulic cylinders, thereby forcing the descending gripper blocks together to firmly grip the continuous rod between them.

U.S. Pat. Nos. 6,880,629 and 8,132,617 disclose grippers for continuous coiled rod injector heads, and each prescribe the use of aluminum at the rod-engaging face of the gripper to avoid scarring or damage the continuous rod that was found or expected to occur if hardened steel was instead used, as was previously proposed for use in coiled tubing applications.

However, Applicant has found that use of aluminum grippers for continuous rod injection has its shortcomings, particularly in that high skate pressures are required to attain sufficient grip, and that injector components undergo notable wear in such high pressure conditions, limiting the effective lifespan of these components.

Accordingly, there remains room for improvement in the area of gripper dies for specific use with continuous coiled rod.

Other prior art in the general area of injector heads and gripper dies for same include U.S. Pat. Nos. 5,094,340, 6,425,441, 6,609,566, 6,892,810, 7,857,042 and U.S. Patent Application Publication 2012/0222855, but these are directed primarily toward coiled tubing applications, and don't address the need for improved solutions in the particular area of continuous coiled rod.

SUMMARY OF THE INVENTION

According to a first aspect of the invention there is provided a gripper die for use in a gripper chain of a continuous rod injector for injecting continuous rod into a well, the gripper die comprising a unitary body consisting of a single ferrous (does the steel need to be described more or is ferrous material purposely used to broaden the description) material throughout said unitary body, which has a base portion adapted to be connected to said gripper chain and a gripping portion defining a gripping face for engaging said continuous rod, the base portion and the gripping portion being seamlessly integrally portions of said unitary body.

Preferably the gripping portion has two ends spaced apart along a longitudinal axis and the gripping face faces away from the base portion, spans a length dimension between the ends of the gripping portion, is profiled in a width direction to contact a periphery of the continuous rod, and is joined to said ends of the gripping portion by transition areas each comprising at least one curved surface smoothly joining said gripping face to a respective one of said ends of the gripping portion.

In one embodiment, the gripper die has a height of 2.25-inches or less, and each transition area preferably consists of a single radiused surface joining said gripping face to a respective one of said ends of the gripping portion.

In another embodiment, the gripper die has a height of 2.25-inches or greater, and each transition area preferably comprises a beveled surface disposed between two radiused surfaces that join said beveled surface to the gripping face and the respective one of the ends of the gripping portion.

Preferably the base portion comprises roller contact surfaces facing opposite the gripping face to ride on skate rollers of the continuous rod injector, and said height is measured from said roller contact surfaces to an extent of the gripping portion furthest therefrom.

Preferably the height of the gripper die is no less than 1.75-inches.

Preferably the gripping face comprises an arcuate gripping surface and a pair of planar gripping surfaces diverging from outer ends of the arcuate gripping surface at an angle greater than 120-degrees between said planar gripping surfaces, said profile being compatible with multiple sizes of both round and elliptical continuous rod through contact of differently sized round rods with the arcuate gripping surface and contact of differently sized elliptical rods with the planar gripping surfaces.

Preferably the angle between said planar gripping surfaces is no greater than 130-degrees.

The arcuate gripping surface of one embodiment has a radius of curvature of approximately 0.563-inches, and spans an arc of approximately 51.5-degrees.

Preferably a profile depth of the gripping face from a center of the arcuate gripping surface to a plane containing ends of the planar gripping surfaces opposite said arcuate gripping surface is between 0.125-inches and 0.475-inches.

Preferably the ferrous material comprises hardened steel.

Preferably the gripper die has a hardness of between 48 and 64 HRC, inclusive.

Preferably the gripping face has ridges and grooves lying in a cross-wise dimension of said gripping face and alternating in a longitudinal dimension of said gripping face.

In one embodiment:

the gripping portion has two opposing ends spaced apart along a longitudinal axis and the gripping face faces away from the base portion, spans a length dimension between the ends of the gripping portion, and is profiled in a width direction to contact a periphery of the continuous rod;

the base portion has a first end configured with an outer pair of coupling ears spaced apart in the width direction by a central gap disposed between said outer pair of coupling ears, a second end configured with a single central ear aligned with the gap, and a hole passing through each ear in the width direction at a position enabling coupling of first and second ones of said gripping die by insertion of the single central ear of the first gripping die into the gap of the second gripping die in a position aligning the hole of said single central ear of the first gripping die with the holes of the outer pair of ears of the second gripping die for pinning together of said gripping dies through said holes; and the ears comprise coplanar roller contact surfaces that face opposite the gripping face in order to ride on rollers of the continuous rod injector, said roller contact surfaces including outer contact surfaces on the outer ears and at least one inner contact surface on the central ear, wherein a combined width of the outer roller contact surfaces equals an overall width of the at least one central roller contact surface.

Preferably the at least one inner contact surface comprises two inner contact surfaces disposed on opposite sides of a central ridge projecting away from the gripping face and lying parallel to the longitudinal axis.

According to a second aspect of the invention there is provided a method of fabricating a gripper die for use in a gripper chain of a continuous rod injector for injecting continuous rod into a well, the method comprising machining the gripper die from a single unitary piece of ferrous material in a manner integrally and seamlessly defining base portion adapted to be connected to said gripper chain and a gripping portion defining a gripping face for engaging said continuous rod.

The method preferably comprises machining a radius into the unitary piece of ferrous material at transitions that join a gripping face of the gripping portion to opposing ends of the gripping portion.

According to a third aspect of the invention there is provided a method of injecting continuous rod into a well, the method comprising gripping the continuous rod between opposing gripping dies carried on a pair of counter-rotating chains, each gripping die having been machined from a respective single unitary piece of ferrous material, wherein the step of gripping the continuous rod between the opposing gripping dies comprises forcing the opposing gripping dies together with a skate pressure of less than 1000 psi.

Preferably the skate pressure is between 600 and 800 psi.

BRIEF DESCRIPTION OF THE DRAWINGS

In the accompanying drawings, which illustrate exemplary embodiments of the present invention.

DETAILED DESCRIPTION

Figure 1:
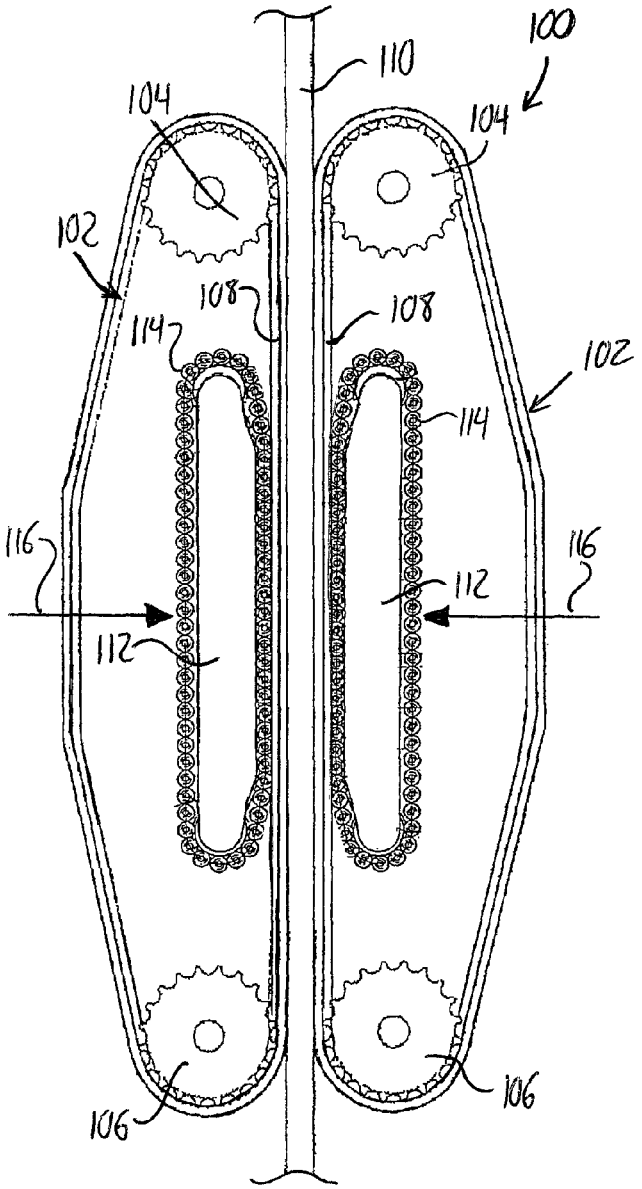
FIG. 1 is a schematic illustration of a continuous coiled rod injection head in which gripping dies of the present invention may be employed.

FIGS. 3A-3E illustrate a gripper die or block 10 of the present invention for use on an injector head 100 operable to convey lengths of continuous rod into and out of a well. FIG. 1 schematically illustrates the general layout of such an injector, as is well known in the art. The injector 100 comprises a frame that supports two continuous, endless drive chain assemblies 102 thereon for rotation of the two chain assemblies in counter-rotating directions within a common vertical plane. Each of the chain assemblies is entrained about at least an upper sprocket 104 and a lower sprocket 106, one of which is driven for rotation by a suitable drive source (not shown), and the other of which may be an idler sprocket arranged to take up the slack in the chain. The path of each of the drive chain assemblies 102 includes an inner vertical run 108 such that the two vertical runs of the chain assemblies run parallel to one another in relatively close proximity with one another on opposite sides of a small space left between them. This space forms a longitudinal path arranged to receive the continuous coiled rod 110 for displacement thereof with the chains in the longitudinal direction of the rod and the vertical runs 108.

A plurality of the gripper dies 10 of identical configuration are coupled to one another and to one or more series of chain links to form a combined chain assembly in which the gripper dies rotate with the chain about the sprockets so that the gripper blocks of the two chain assemblies face toward one another along the vertical runs of the drive chains for gripping opposing sides of the continuous rod 110 received therebetween. For ease of illustration, the chain assemblies of FIG. 1 are drawn without detail, but the general makeup of each chain assembly and the detailed structure of each gripper die 10 are described herein further below in greater detail, for example with reference to FIG. 2.

In order to apply a gripping pressure to clamp or grip the continuous rod 110 between the opposed vertical runs of the chain assemblies, each of the vertical runs of the chain assemblies are provided with skates 112 which apply pressure to the chain assemblies 102 on the interior side thereof opposite the continuous rod 110 disposed between the chain assemblies such that when the opposed skates 112 of the two drive chain assemblies are urged towards one another, the gripper dies on opposing sides of the rod are forced toward one another, and thereby tightened against the respective sides of the continuous rod 110. As illustrated, the skates 112 will include rollers 114 to reduce friction of the drive chain assemblies sliding along the skates in the longitudinal direction. Suitable hydraulic rams (not shown) can be used to apply pressure to the skates 112 for producing the clamping force on opposing sides of the continuous rod 110, as generally indicated by arrows 116 illustrating forcing of the two skates together. By increasing the hydraulic pressure, an increased clamping pressure is applied to the opposed gripper blocks, increasing the clamping effect on the continuous rod 110 therebetween.

Turning to FIG. 3, each gripping die 10 is machined from a single piece of steel stock in order to have a seamlessly integral, unitary body structure of uniform material throughout. A base portion 12 forms the part of the die configured for connection within the drive chain links of the injection head, and a gripping portion 14 forms the interface for engagement against the continuous rod. In FIG. 3A, orthogonal X, Y and Z axes are used to denote vertical height, horizontal length and horizontal width directions used in the subsequent description of the illustrated die. Using this directional convention, any use of terms such as 'height', 'up', 'down', 'top', 'bottom', 'above', 'below', or the like are used to provide spatial description in relation to the vertical Y axis shown in the figure, and are not used in a manner intended to reflect a particular orientation in which the die must reside during use. Likewise, terms such as 'length', 'ends', 'front', 'forward', 'rear', 'back' or the like are used in relation to the illustrated X axis, and terms such as 'width' and 'sides' are used in relation to the illustrated Z axis.

The gripping portion 14 of the die is generally in the form of a block having identical vertical front and rear end faces 16, 18 that are spaced apart along the length direction and each lie parallel to the Z-axis so as to run in the width direction of the die. Rectangular vertical side faces 20, 22 interconnect the front and rear faces at ends thereof in lengthwise planes parallel to the X-axis. A top face 24 of the gripping portion 14 faces upwardly away from the base portion 12 and substantially spans both the full width of the die between the side faces 20, 22 of the gripping portion and the full length of the gripping portion between the end faces 16, 18 thereof. The top face 24 is profiled in the width direction, having a central arcuate portion 24*a* curving concavely about the X-axis with a radius of curvature R of 0.563-inches and an angular span A1 of 51.954-degrees. On each side of the central arcuate portion 24*a*, a respective planar portion 24*b* of the top face 24 slopes upward and outward from a respective end of the arcuate span at an angle A2 of approximately 27-degrees above horizontal, making the angle between the two sloped planar portions 24*b* approximately 126-127 degrees. At the top ends of these sloped planar portions 24*b*, the top face levels out horizontally to reach out toward the side faces 20, 22 of the gripping portion. The total width W spanned by the arcuate and sloped planar portions 24*a*, 24*b* between the two horizontal outer portions 24*c* is 1.401-inches.

The base portion 12 of the die 10 features a pair of outer ears 26 that jut forwardly out from under the gripping portion 14 in the length direction, past the front end face 16 thereof. Each outer ear 26 has flat inner and outer side faces 26*a*, 26*b* that lie parallel to the lengthwise X-Y plane of the die. The two outer ears 26 are identical, lying in alignment with one another across a gap or space 28 disposed between their inner faces 26*a*.This gap 28 extends rearwardly lengthwise into the die from the front end thereof to a location underlying a front portion of the gripping portion 14, but stopping short of a central point along the length dimension L of the gripping portion. The outer ears 26 feature aligned holes 30 passing through them in the width direction, i.e. parallel to the Z axis. A forward edge surface 26*c* of each outer ear 26 joins flush with the front face 16 of the gripping portion 14, curving smoothly forward therefrom and then curving concentrically about the hole 30 until reaching a lower front quadrant therearound, where the forward edge surface 26*c* then slopes downward and rearward in a planar fashion to a planar horizontal bottom surface 26*d* of the ear.

The matching, coplanar bottom surfaces 26*d* of the outer ears extend rearward past the lengthwise center of the gripping portion 14, eventually joining to a rear edge surface 26*e* that first turns vertically upward, and then curves rearward to join up with the rear end face 18 of the gripping portion. The horizontal outer portions 24*c* of the gripping surface 24 overhang beyond the outer faces 26*b* of the respective outer ears 26, and a sloped underside 27 of this overhang joins the bottom end of the respective vertical side 20, 22 of the gripping portion to the top end of the outer face 26*b* of the respective outer ear 26.

Figure 3B:
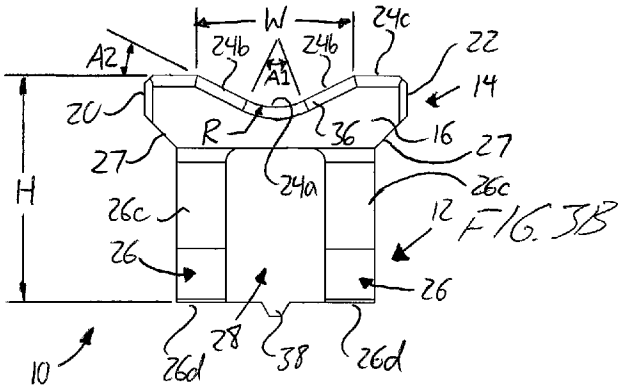
FIGS. 3A, 3B, 3C, 3D and 3E are perspective, end, top, side and bottom views of a gripper die according to a first embodiment of the present invention.
Figure 3A:
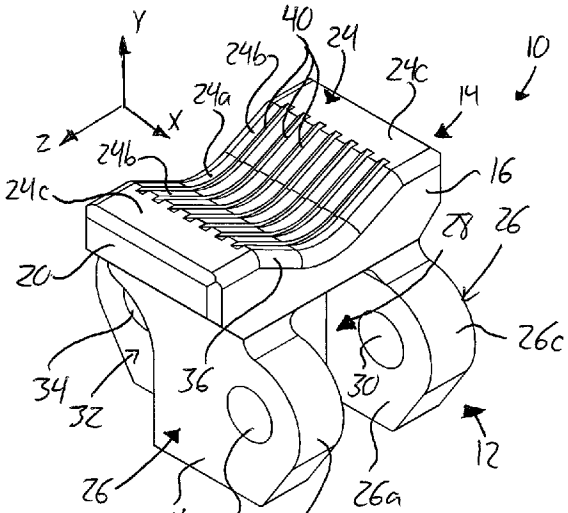
Figure 3C:
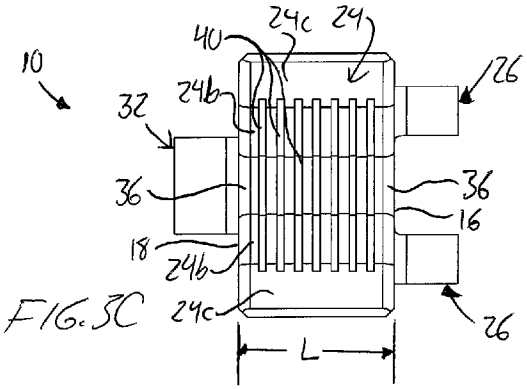
Figure 3D:
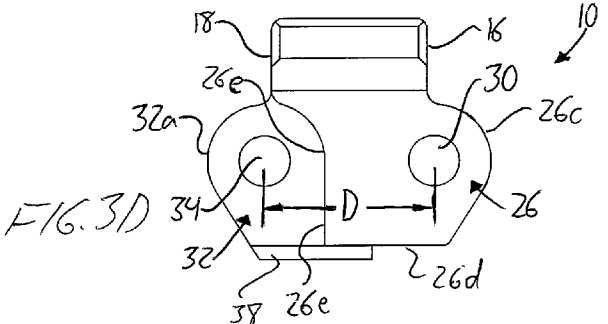
Figure 3E:
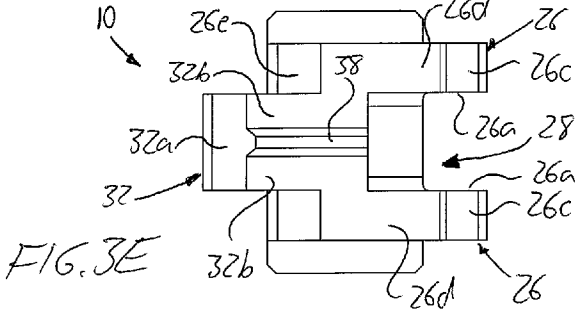

While the front of the base portion features two outer ears 26 with a gap 28 therebetween, the rear of the base portion 12 features the reverse configuration, particularly a single central ear 32 that juts out from under the gripping portion 14 in the length direction, past the rear end face 18 thereof. The position of the central ear 32 across the width of the die aligns with the gap 28 in the front end thereof, and the central ear 32 has a width just slightly less than that of the gap 28. A profile of a rear edge surface 32*a* of the central ear 32 mirrors that of the front edge surface of each outer ear 26, as best shown in FIG. 3D, first extending downward in flush extension of the rear face 18 of the gripping portion 14, then curving concentrically about the axis of a round hole 34 passing widthwise through the central ear 32 before sloping linearly to a bottom of the ear 32. The central ear 32 at the rear of one die is insertable into the gap 28 at the front of another die in a manner bringing the through-hole 34 of the central ear 32 of the one die into axial alignment with the through-holes 30 of the outer ears of the other die. The curved upper portion of the rear edge surface 26*e* of each outer ear curves concentrically about the hole 34 of the central ear 32 to accommodate the matching curve of the front edge surfaces of the outer ears of the other die.

Figure 2:
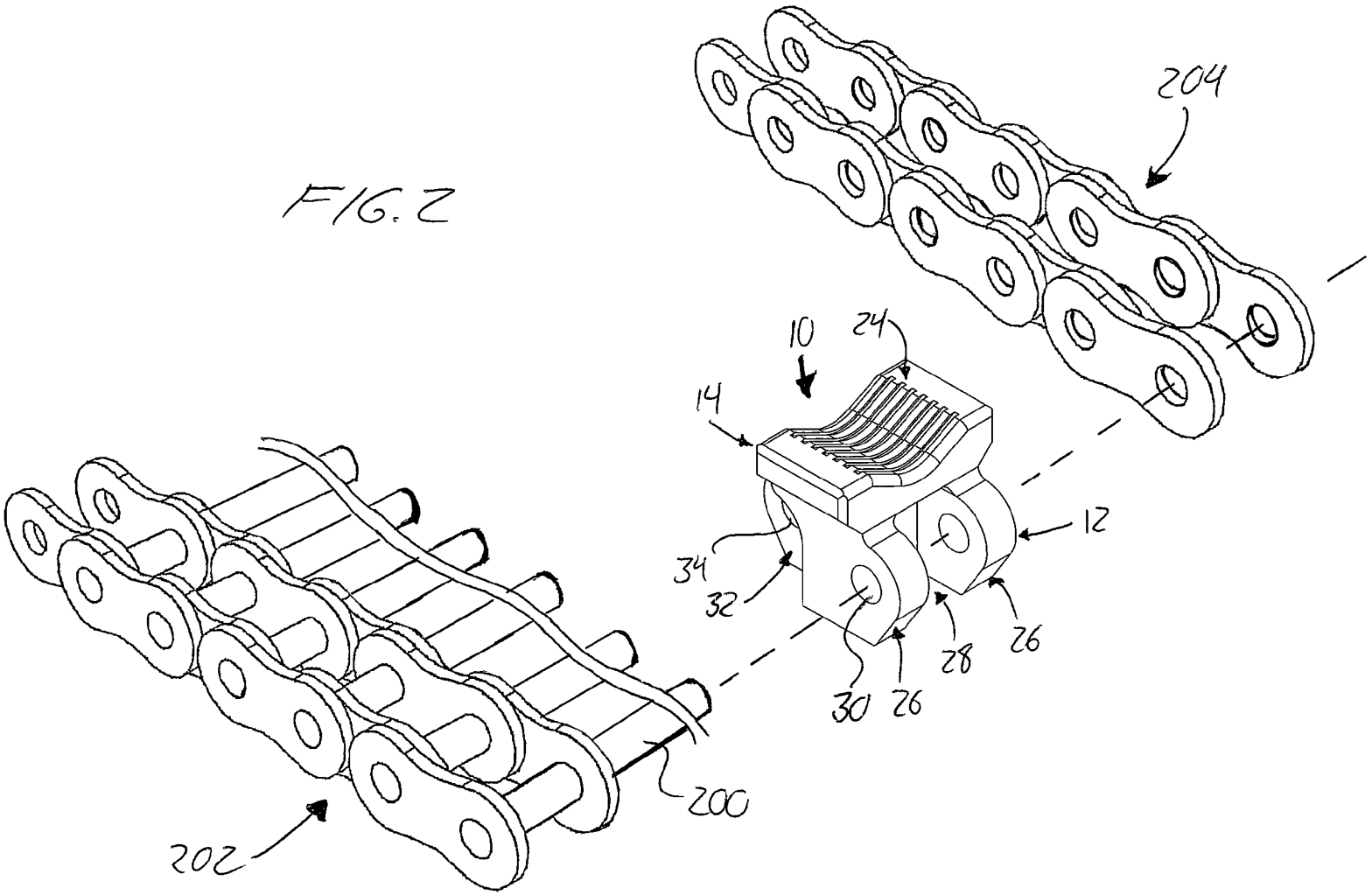
FIG. 2 is an exploded schematic view illustrating assembly of gripper dies of the present invention into a chain loop for a continuous coiled rod injection head.

FIG. 2 illustrates assembly of one of the dies into the chain assembly of the above described injector. A series of dies essentially take the place of the middle links in what would otherwise be a triple-width chain, with an outer series of links disposed on each side of such a series of middle lengths. As shown in the Figure, each pin 200 that connects a link of an outer series of links 202 to the respective link in the other outer series of links 204 passes through the holes 30 in the outer ears 26 of a respective gripper die 10 while doing so, thereby securing the gripping die between these two outer links of the triple-wide chain. Although FIG. 2 shows only a single die, it will be appreciated that a series of dies are mated together in the above described fashion that aligns the outer ear and central ear holes 30, 34 of adjacent dies in the series, whereby the pin 200 in FIG. 2 will not only pass through the outer ear holes 30 of the illustrated die, but also through the central ear hole 32 of an adjacent die in the series. Each die is thus secured in place by two adjacent pins of the chain.

As adjacent dies 10 in the series move along the vertical runs of the chain assemblies 102 of the injector 100, where the dies thus reside in matching orientations with their longitudinal X-axis lying parallel to the vertical direction of movement, the gripping portions of the adjacent dies will thus lie parallel to one another with their end faces in abutment, or in closely adjacent condition, to form a substantially continuous gripping surface along the portion of the continuous rod being fed through the injector.

To avoid sharp edges that may otherwise cause damage to the surface of the continuous rod as the gripping dies 10 turn downward and inward over the upper sprockets 104 of the injector into engagement with the continuous rod, the die 10 of FIG. 3 is provided with radiused transitions 36 joining the opposite ends of the top gripping surface 24 to the end faces 16, 18 of the gripping portion. Applicant has found that when a height H of the die 10 is less than or equal to 2.25-inches, such a single-radius transition is sufficient to avoid damage to the continuous rod. The embodiment of FIG. 3 is based on a prototype having a height H of 2.028-inches, and a 0.100-inch curvature radius at the single-radius transition.

Figure 5:
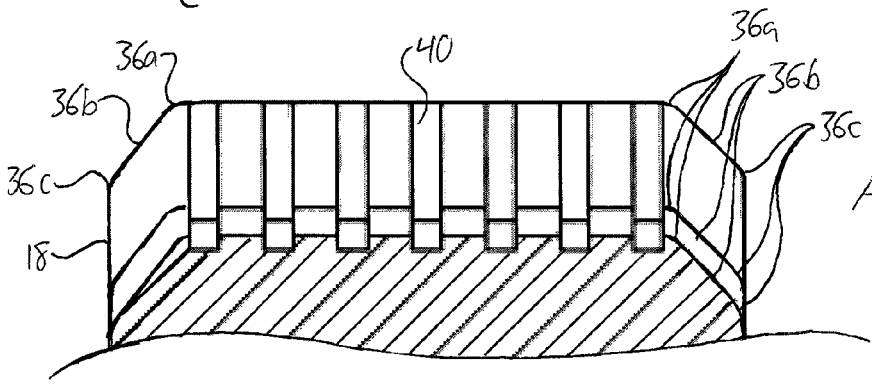
FIG. 5 is a partial cross-sectional view like that of FIG. 4C, but of a third embodiment die that uses a multi-radiused transition from a gripping face of the die to a respective end of a gripping portion thereof.

However, for die models of greater height, a single-radius transition may not provide sufficient clearance to avoid harmful impact of the die against to continuous rod as the die moves into and out of contact with the rod at the top and bottom ends of the vertical run. Accordingly, another embodiment of the die 10" shown in FIG. 5 features a multi-stage transition from the top gripping surfaces to each end face of the gripping portion, where an upper radiused surface 36*a* smoothly joins the top gripping face 24 to a chamfered or beveled surface 36*b* sloping linearly at an oblique orientation relative to both the horizontal orientation of the top surface's lengthwise dimension and the vertical orientation of the end face 16/18 of the gripping portion. The chamfered or beveled surface 36*b* is in turn joined to the respective end face 16/18 of the gripping portion by a lower radiused surface 36*c*.The chamfered configuration of the transitions provides clearance between the die and the continuous rod as the die moves into and out of the vertical run about the upper and lower sprockets, and the two radiused ends of the transition avoid sharp edges that might otherwise score the continuous rod.

The illustrated die has a ridge or tongue 38 of inverted trapezoidal cross-section projecting downward from the otherwise flat underside 32*b* of the central ear 32, and running centrally therealong in the lengthwise direction of the die. The flat remainder 32*b* of the underside of the central ear 32 is coplanar with, and flushly joined with, the flat undersides 26*e* of the two outer ears 26. These flat bottoms 32*b*, 26*e* form roller contact surfaces that ride over the rollers 114 of the skates 112 during movement through the vertical run of the injector 100. The skate rollers 114 are arranged in aligned pairs with one roller on each side of the central ridge 38, which juts into the space between the two rollers of each pair to act as a guide to keep the dies on a desired linear vertical path. The aforementioned height dimension is measured from the flat coplanar roller contact surfaces of the ears to the uppermost extent of the gripping portion (i.e. the horizontal outer portions 24*c* in the illustrated embodiment), and thus does not include the height of the ridge, which for example adds an additional 0.125-inches of height to the aforementioned prototype, bringing the total height to 2.153-inches.

Although not reflected to scale in the drawings, the combined width of the flat roller contact surfaces 26*e* of the two outer ears 26 is equal to the combined width of the flat roller contact surfaces 32*b* of the bottom of the central ear on opposite sides of the ridge 38. As a result, when two dies are mated together and moving along the vertical run of the injector in matching orientations with the flat roller contact surfaces 26*e*, 32*b* of their ears all coplanar with one another, the force applied by an aligned pair of rollers against the undersides 26*e* of the outer ears of one die and the underside 32*b* of the central ear of the next die received between these outer ears of the first die is evenly distributed between the two dies, creating an even pressure distribution across the width of these mated dies so as to distribute the gripping force evenly among contact points of the dies' gripping faces 24 with the continuous rod.

To contribute to even gripping force distribution over the length L of the gripping face 24 of each die 10, the length L of the gripping face is centered on the lengthwise distance D between the pin accommodating holes 30 of the outer ears 26 near the front end of the die and the pin accommodating hole 34 of the central ear 32 near the rear end of the die. The distance D for the illustrated embodiment of FIG. 3, which is configured for use with 120 or 140 pitch chains, particularly 120-3 or 140-3 ANSI standard roller chain, is 1.500 inches.

A series of grooves 40 are machined into the gripping surface 24 to each run in the widthwise direction thereof from one of the horizontal outer surfaces 24*c* to the other, for example with a uniform groove depth of 0.030-inches and uniform groove width of 0.063-inches. This series of parallel grooves creates a pattern of alternating grooves and ridges along the length dimension L of the gripping portion, for example with a ridge width of 0.097-inches between each pair of adjacent grooves.

Other dimensions of the prototype illustrated in FIG. 3 that are not mentioned above include an overall length of 2.515-inches from the forwardmost extent of the outer ears 26 to the rearwardmost extent of the central ear 32, and an overall width of 2.350-inches from the one vertical side face 20 of the gripping portion to the other 22.

The angle between the two sides of the trapezoidal ridge is between 22 and 45-degrees, particularly 33-degrees in the illustrated embodiment. The angle between the sloped planar portions 24*b* of the top gripping surface 24 may be altered to 100-degrees or less, but this would limit the rod sizes with which the die is compatible, or may be increased up to about 150 degrees, but this may cause centralizing and alignment problems. The depth d of the gripping surface profile, measured from the uppermost extent at the outer horizontal portions 24*c* to the central lowermost point of the arcuate portion 24*a* is between 0.125-inches and 0.475-inches, and preferably 0.285-inches to maximize the range of rod sizes with which the die is compatible. The hole diameters may be between 0.437-inches and 0.525-inches, for example 0.455-inches for the illustrated embodiment. The length L of the gripping surface 24 does not exceed 1.5-inches (i.e. the hole-to-hole distance D), for example at 1.375-inches in the illustrated embodiment, and reduced for other embodiments having a greater height H.

The material may be 4140 steel treated to a hardness between 52 and 56 HRC (Rockwell Hardness; C scale), inclusive, but other hardenable ferrous materials may be employed, preferably through-hardened or surface-hardened to a level between 48 and 64 HRC, and most preferably between 52 and 62 HRC. Another example of suitable material is 8620 steel.

Figure 4C:
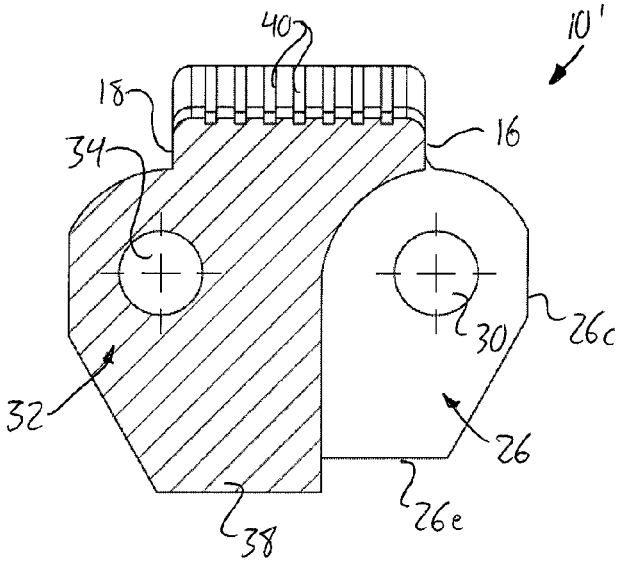
FIG. 4C is a cross-sectional view as taken along line C-C of FIG. 4B.
Figure 4B:
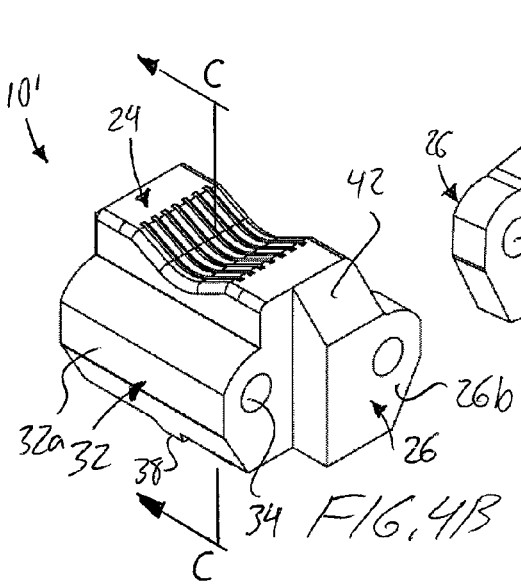
FIGS. 4A and 4B and front and rear perspective views of a gripper die according to a second aspect of the present invention.
Figure 4A:
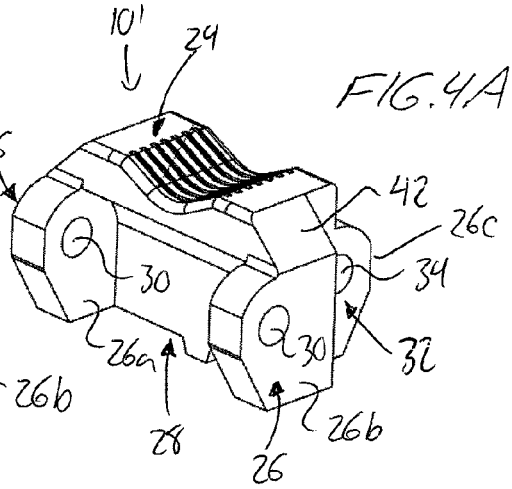

FIG. 4 illustrates a second embodiment gripper die 10' with the same size and shape gripping portion, and matching gripping surface profile and dimensions of the forgoing embodiment of FIG. 3, but configured with a slightly different base design for use with 120 or 140 pitch chain, particularly 120-4 or 140-4 ANSI standard roller chain. The general layout of the base is similar, with outer ears at one end and a single central ear at the other to fit between the outer ears of the next die in the chain assembly, but the width of the base portion exceeds that of the gripper portion, whereby outer ears reside laterally outward of the gripping portion, and a respective inclined surface 42 joins the outer edge of each outer horizontal portion 24*c* of the gripping surface 24 to the top edge of the outer face 26*b* of the respective outer ear over for over half, but less than all, of the gripping face length L. The overall width is thus greater than the preceding embodiment, at 3.562 inches, and is defined between the outer side faces of the outer ears, not between the sides of the gripping portion. The overall height is 2.313 inches, which without the ridge 38, provides a height less than 2.25-inches from the coplanar roller contact surfaces at the underside of the ears to the uppermost extent of the gripper faces, and so this embodiment again features a single-radius transition at each end of the gripper face. The embodiment of FIG. 4 also features a flattened vertical portion of the edge surface 26*c*, 32*a* of each ear, which acts to shorten the concentric curvature of this edge about the axis of the through hole of the ear compared to the preceding embodiment.

It will be appreciated the dimensions specified above for particular embodiments are not intended to limit the scope of the present invention beyond the limitations set forth in the appended claims.

Figure 6:
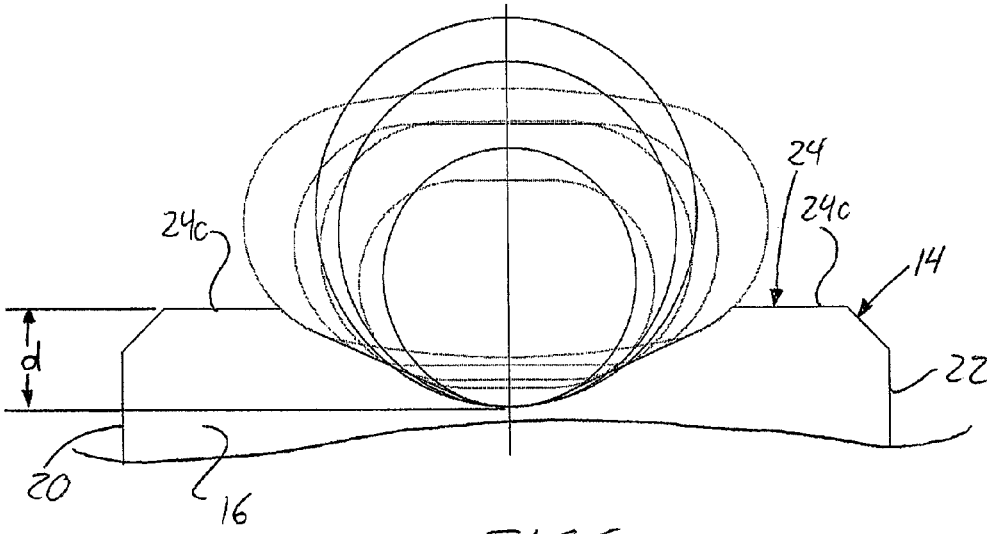
FIG. 6 is a schematic illustration demonstrating accommodation of different continuous rod sizes, both round and elliptical, by a gripping surface profile of gripper dies of the present invention.

The above described profile shape of the top gripping surface 24 has been found effective for gripping any one of four standard elliptical continuous sizes and round continuous rods of 1-⅛ inch, 1 inch, and ¾ inch diameter, as schematically illustrated in FIG. 6, thereby providing an extreme amount of flexibility through use of the same die.

The integral gripper block or die of the present invention presents both the drive chain or carrier component and the gripper surface in one unitary body. The conventional way to manufacture one piece gripper blocks and/or drive pockets or carriers that carry separate gripper pads is through the casting process, which may produce poor quality parts and inconsistencies due to imperfections that can result from the casting process itself. Cast steel blocks break easily due to porosity and grain structure or lack thereof. Fully machined dies produced in accordance with the present invention can be produced with consistent accuracy within a 5-thou tolerance with exceptional surface finish and repeatability compared to casted dies that Applicant has used, as some such casted dies were found to have been out up to 35-thou with a surface texture and design structure which would leave impressions and scar the outer diameter of the rod.

In view of the prior art teaching that use of steel dies on continuous rod will score the rod, it is surprising that Applicant has managed to design a machined, steel die that does not score the rod, especially with inclusion of the above described evacuation grooves to allow oil, wax, etc. into the grooves for better grip on the high side of the die face. As well, the entry and exit radiuses on the die face contribute to prevention of marking of the rod as the die comes over the sprockets and meets with the rod.

The above described profile of the die face has been designed to grip on seven commercially available sizes of elliptical continuous coiled rod (sizes 2, 3, 4, 5, 6, 7 & 8), thus being compatible with not only the four most common sizes (3, 4, 5 & 6), but also with less commonly used, but available elliptical rod. The die face is also operable to grip five available sizes of round continuous coiled rod (1-3/16-inch, 1-1/8-inch, 1-inch, 7/8-inch & 3/4-inch diameters). The die provides exceptional grip at low skate pressures without damaging/marking the rod. Applicants testing shows that for a typical 1000-meter well, up to 2500 psi skate pressure was required with prior art aluminum saddle-type dies, where as steel ribbed/grooved dies of the present invention allow use of skate pressures as low as 600 psi. This may result in up to three times the usable life from the main chains, skate chains & rollers, and skate bars due to reduced wear of same under these lower pressure operational conditions.

From past experience, Applicant has found that the typical life expectancy for aluminum inserts is 3-4 months, whereas a dramatically longer wear life of up to 5 years is expected from the machined, hardened steel dies of the present invention. Even with prior art cast steel dies used in a coil tubing environment, they were found to be prone to cracking easily because of the poor quality and grain structure. Therefore, not only is it surprising that hardened steel dies can be used on continuous rod without damage to the same, but the performance and lifespan of the product is dramatically improved by machining, instead of casting, a seamlessly unitary one-piece die specifically for use with continuous coiled rod (not coil tubing, nor conventional threaded-together sucker rods or polish rods).

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A gripper die for use in a gripper chain of a continuous rod injector for injecting continuous rod into a well, the gripper die comprising a unitary body consisting of a single ferrous material throughout said unitary body, which has a base portion adapted to be connected to the respective gripper chain and a gripping portion defining a gripping face for engaging said continuous rod, the base portion and the gripping portion being seamlessly integral portions of said unitary body;

wherein the gripping portion of each gripper die has two ends spaced apart along a longitudinal axis, and the gripping face faces away from the base portion, spans a length dimension between the ends of the gripping portion, is profiled in a width direction to contact a periphery of the continuous rod, and is joined to said ends of the gripping portion by transition areas each comprising at least one curved surface smoothly joining said gripping face to a respective one of said ends of the gripping portion; and wherein a profile of the gripping face comprises an arcuate gripping surface and a pair of planar gripping surfaces diverging from outer ends of the arcuate gripping surface at an angle greater than 120-degrees between said planar gripping surfaces, said profile being compatible with multiple sizes of both round and elliptical continuous rod through contact of differently sized round rods with the arcuate gripping surface and contact of differently sized elliptical rods with the planar gripping surfaces.

2. The gripper die of claim 1 wherein the transition area consists of a single radiused surface joining said gripping face to a respective one of said ends of the gripping portion.

3. The gripper die of claim 2 having a height of 2.25-inches or less.

4. The gripper die of claim 3 wherein the base portion comprises roller contact surfaces facing opposite the gripping face to ride on skate rollers of the continuous rod injector, and said height is measured from said roller contact surfaces to an extent of the gripping portion furthest therefrom.

5. The gripper die of claim 3 wherein the height of the gripper die is no less than 1.75-inches.

6. The gripper die of claim 1 wherein the transition area comprises a beveled surface disposed between two radiused surfaces that join said beveled surface to the gripping face and the respective one of the ends of the gripping portion.

7. The gripper die of claim 6 having a height of 2.25-inches or greater.

8. The gripper die of claim 1 wherein the angle between said planar gripping surfaces is no greater than 130-degrees.

9. The gripper die of claim 1 wherein a profile depth of the gripping face from a center of the arcuate gripping surface to a plane containing ends of the planar gripping surfaces opposite said arcuate gripping surface is between 0.125-inches and 0.475-inches.

10. The gripper die of claim 1 wherein the ferrous material comprises steel.

11. The gripper die of claim 1 wherein the ferrous material comprises hardened steel.

12. The gripper die of claim 1 having a hardness of between 48 and 64 HRC, inclusive.

13. The gripper die of claim 1 wherein the gripping face has ridges and grooves lying in a cross-wise dimension of said gripping face and alternating in a longitudinal dimension of said gripping face.

14. The gripper die of claim 1 wherein: the base portion has a first end configured with an outer pair of coupling ears spaced apart in the width direction by a central gap disposed between said outer pair of coupling ears, a second end configured with a single central ear aligned with the gap, and a hole passing through each ear in the width direction at a position enabling coupling of first and second ones of said gripping die by insertion of the single central ear of the first gripping die into the gap of the second gripping die in a position aligning the hole of said single central ear of the first gripping die with the holes of the outer pair of ears of the second gripping die for pinning together of said gripping dies through said holes; and the ears comprise coplanar roller contact surfaces that face opposite the gripping face in order to ride on rollers of the continuous rod injector, said roller contact surfaces including outer contact surfaces on the outer ears and at least one inner contact surface on the central ear, wherein a combined width of the outer roller contact surfaces equals an overall width of the at least one central roller contact surface.

15. The gripper die of claim 14 wherein the at least one inner contact surface comprises two inner contact surfaces disposed on opposite sides of a central ridge projecting away from the gripping face and lying parallel to the longitudinal axis.

16. A continuous rod injection system for injecting continuous rod into a well, said system comprising:

two sets of gripper dies according to claim 1;

a continuous rod; and a continuous rod injector head comprising two endless gripper chains arranged for driven operation in counter-rotating directions on opposite sides of a longitudinal path in which the continuous rod is receivable for driven displacement thereof by the endless gripper chains, the two sets of gripper dies being carried respectively on the two endless gripper chains in positions facing one another across the longitudinal path for gripping of the continuous rod between said two sets of gripper dies.

17. A method of fabricating a gripper die for use in a gripper chain of a continuous rod injector for injecting continuous rod into a well, the method comprising machining the gripper die from a single unitary piece of ferrous material in a manner that:

integrally and seamlessly defines a base portion adapted to be connected to said gripper chain and a gripping portion for engaging said continuous rod;

provides the gripping portion with a gripping face that faces away from the base portion, spans a length dimension between ends of the gripping portion spaced apart along a longitudinal axis, is profiled in a width direction to contact a periphery of the continuous rod, and is joined to said ends of the gripping portion by transition areas each comprising at least one curved surface smoothly joining said gripping face to a respective one of said ends of the gripping portion; and provides the gripping portion with a profile that comprises an arcuate gripping surface and a pair of planar gripping surfaces diverging from outer ends of the arcuate gripping surface at an angle greater than 120-degrees between said planar gripping surfaces such that said profile is compatible with multiple sizes of both round and elliptical continuous rod through contact of differently-sized round continuous rod with the arcuate gripping surface and contact of differently-sized elliptical continuous rods with the planar gripping surface.

18. A method of injecting continuous rod into a well, the method comprising:

gripping the continuous rod between opposing gripping dies respectively carried on a pair of counter-rotating chains by forcing the opposing gripping dies together with a skate pressure of less than 1000 psi;

wherein:

each gripping die comprises a unitary body consisting of a single ferrous material throughout said unitary body, which has a base portion connected to the respective chain and a gripping portion defining a gripping face for engaging the continuous rod, the base portion and the gripping portion being seamlessly integral portions of said unitary body;

the gripping portion of each gripper die has two ends spaced apart along a longitudinal axis and the gripping face faces away from the base portion, spans a length dimension between the ends of the gripping portion, is profiled in a width direction to contact a periphery of the continuous rod, and is joined to said ends of the gripping portion by transition areas each comprising at least one curved surface smoothly joining said gripping face to a respective one of said ends of the gripping portion; and a profile of the gripping face comprises an arcuate gripping surface and a pair of planar gripping surfaces diverging from outer ends of the arcuate gripping surface at an angle greater than 120-degrees between said planar gripping surfaces, said profile being compatible with multiple sizes of both round and elliptical continuous rod through contact of differently sized round rods with the arcuate gripping surface and contact of differently sized elliptical rods with the planar gripping surface.

* * * * *